United States Patent [19]

Plummer

[11] 3,979,151

[45] Sept. 7, 1976

[54] ROCK EXCAVATING ARCHED TUNNEL FORMING MACHINE

[75] Inventor: Derek Plummer, Burton-on-Trent, England

[73] Assignee: Coal Industry (Patents) Limited, London, England

[22] Filed: Feb. 13, 1975

[21] Appl. No.: 549,725

[30] Foreign Application Priority Data

Mar. 1, 1974 United Kingdom ..... 9330/74

[52] U.S. Cl. ..... 299/31; 299/71

[51] Int. Cl.[2] ..... E21C 29/00

[58] Field of Search ..... 299/31, 71

[56] References Cited

UNITED STATES PATENTS

| | | | |
|---|---|---|---|
| 1,978,366 | 10/1934 | Levin | 299/71 |
| 2,020,003 | 11/1935 | Sloane | 299/71 |
| 3,290,095 | 12/1966 | Bredthauer | 299/71 X |
| 3,442,554 | 5/1969 | Paul | 299/31 X |
| 3,446,535 | 5/1969 | Lauber | 299/31 |
| 3,647,263 | 3/1972 | Lauber et al. | 299/31 |
| 3,695,717 | 10/1972 | Birrer | 299/31 |

*Primary Examiner*—Ernest R. Purser
*Assistant Examiner*—Richard E. Favreau
*Attorney, Agent, or Firm*—James C. Wray

[57] ABSTRACT

A rock excavating machine for forming an arch type underground roadway includes a base carrying a forwardly extending cutter carrying arm having a cutter for cutting rock adjacent to the roadway floor and an upwardly extending cutter carrying arm having a cutter for cutting rock adjacent to the raodway roof. The forwardly extending cutter is mounted on an arm which swings around a vertical axis, and which is elevatable along the vertical axis. The upwardly extending cutter carrying arm swings around a horizontal axis. Roof support jacks and beams are mounted on the base rearwardly of the cutters. Lateral jacks anchor the machine in the tunnel during cutting.

11 Claims, 4 Drawing Figures

ROCK EXCAVATING ARCHED TUNNEL FORMING MACHINE

This invention relates to rock excavating machines and in particular to rock excavating machines for forming arch type underground roadways. Such roadways are generally "D" shaped in cross-sectional area with the straight boundary constituting the roadway floor and with well known mine roof support arches set to support the curved sides and roof of the roadway.

An object of the present invention is to provide an improved rock excavating machine for forming arch type roadways.

According to the present invention a rock excavating machine for forming arch type underground roadways comprises a forwardly extending cutter carrying arm pivotable about a generally vertical axis and an upwardly extending cutter carrying arm pivotable about a generally horizontal axis.

Preferably, the machine comprises an advanceable base supporting both said arms.

Advantageously, both said arms are arranged to carry rotary cutter heads for rotation about horizontal axes.

Conveniently, the machine includes a stay unit connected to the base by at least one advancing ram.

Preferably, both the base and the stay unit include roof support assemblies.

Preferably, both roof support assemblies are adapted to extend over the base.

Conveniently, at least one of the roof support assemblies comprises roof engaging members and a shield component mounted below the roof engaging members.

Advantageously, the base is provided with at least one ram for releasably anchoring the base in the roadway.

Preferably, guide pads are mounted on the sides of the base to steer the machine in a generally horizontal plane.

Preferably, means are provided for raising and lowering the forwardly extending cutter carrying arm to steer the machine in a vertical plane.

In alternative embodiments of the invention the advanceable base is independent of the roof support assembly. In such embodiments the machine may have vertical rams to assist anchoring during cutting.

In further alternative embodiments of the invention the roof support assembly is slidably mounted relative to the machine allowing the machine to be advanced several stages before the roof support assembly is advanced.

In still further alternative embodiments of the invention the conveyors are replaced by a round-the-houses conveyor.

One embodiment of the present invention will be described with reference to the accompanying drawings, in which.

Figure 2:
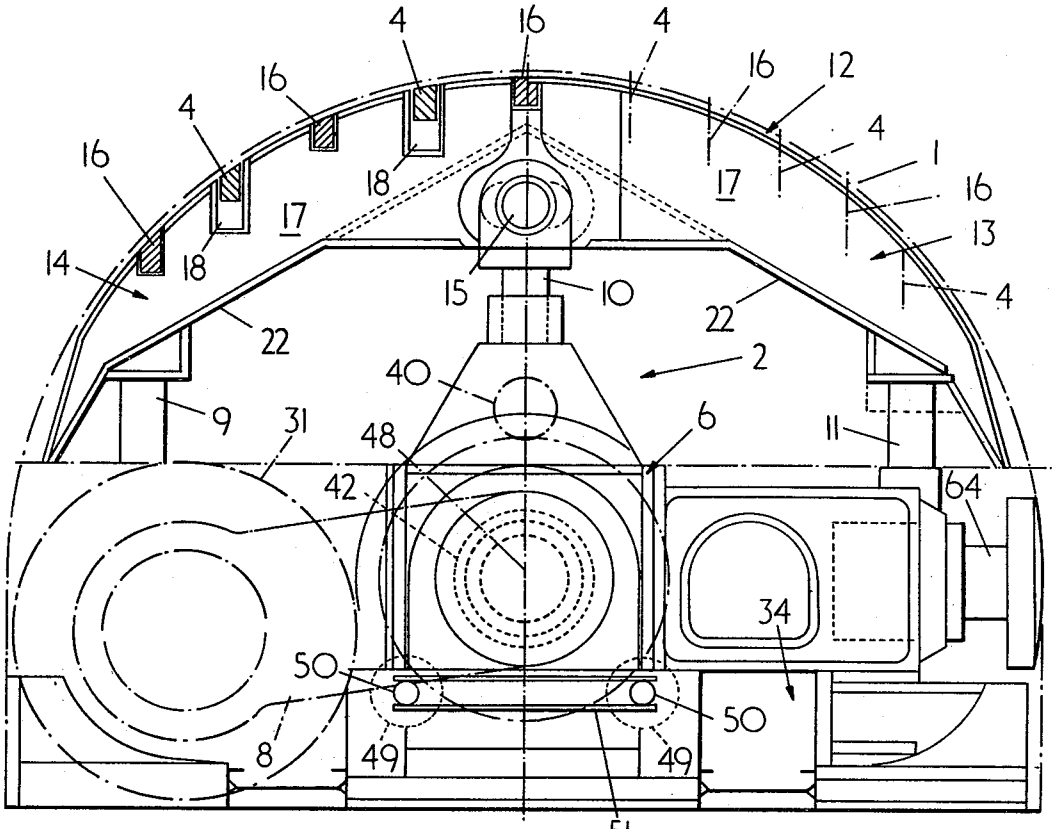
FIG. 2 is an incomplete front view of FIG. 1.

Referring to the drawings, the rock excavating machine is shown forming an arch type underground roadway 1 of generally D-shaped cross-sectional area and supported by arch section beams (not shown). The machine comprises a leading portion 2 and a stay or trailing unit 3 (see FIG. 4) only a part of which is shown in FIG. 2 indicated by roof beams 4 extending over the leading portion. The leading portion is connected to the stay unit by two advancing rams 5 parts of which are shown in FIG. 3 and the ends of which are mounted in pivoted mountings (not shown).

Figure 3:
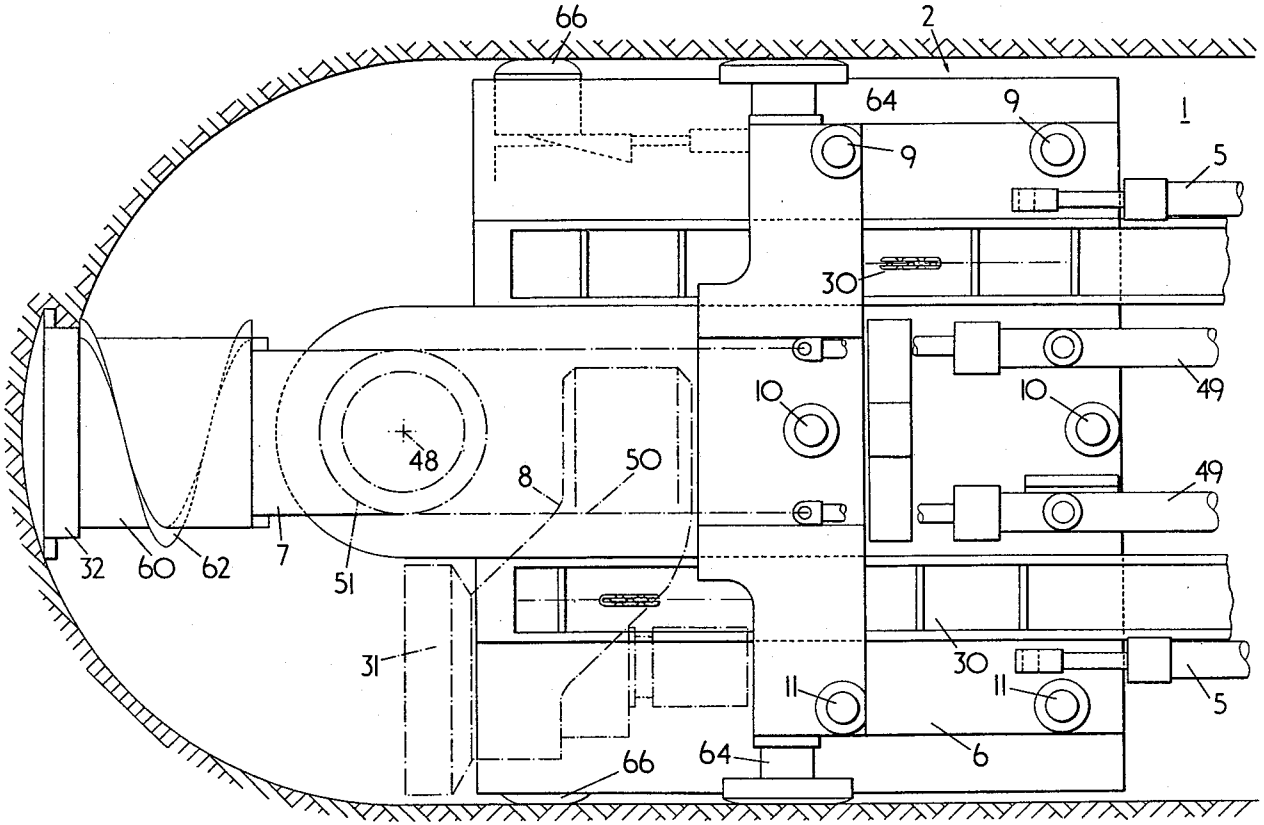
FIG. 3 is an incomplete plan of FIG. 1 with an upper portion of the machine removed.
Figure 4:
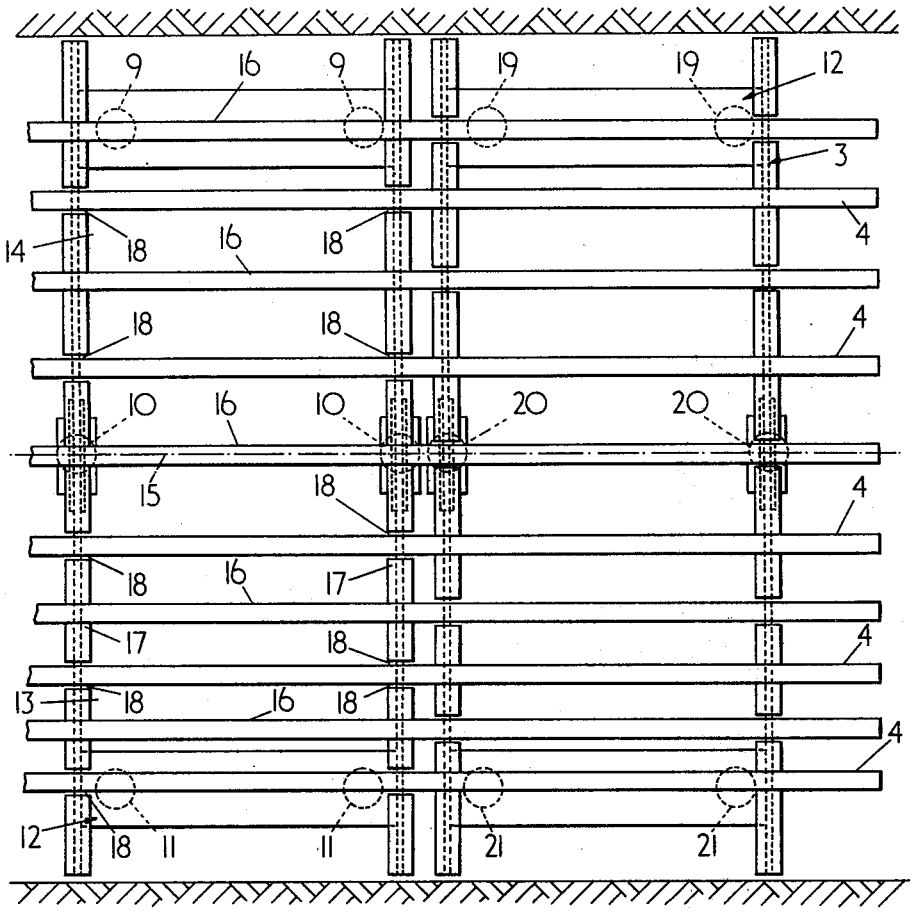
FIG. 4 is an incomplete plan of the machine with the upper portion in place.

The leading portion 2 comprises an advanceable base 6 pivotally supporting a forwardly extending cutter head carrying arm 7 (not shown in FIG. 2) and an upwardly extending cutter head arm 8 (not shown in FIG. 3). Three pairs of extensible props, 9, 10 and 11 carried by the base support a curved roof support assembly 12 (not shown in FIG. 1) including two sections 13 and 14 pivotally interconnected by a pin 15 along the crown of the roof support assembly. Each section 13, 14 comprises a plurality of parallel roof engaging beams 16 fixedly mounted on curved cross members 17 having cut-outs 18 to accommodate the roof beams 4 of the stay units which are capable of being released from the roof independently of the roof support assembly 12 by the action of three pairs of extensible props, 19 20 and 21. The roof support assembly of the stay unit 3 is of a similar construction to that of the roof support assembly 12. Each section 13, 14 also comprises a shield 22 secured below the roof engaging beams 16.

The advanceable base 6 carries two conveyors 30 for conveying cut rock from the vicinity of rotary cutter heads 31 and 32 carried on the arms 7 and 8, respectively, towards conveying means (not shown) for example mine cars or a belt conveyor, situated at the rear of the stay unit 3. The conveyors 30 pass through tunnels 34 (only one of which can be seen in FIG. 2) provided in the base 6.

The rotary head 31 is driven by a motor 35 via gearbox 36 carried by the upwardly extending arm 8 which is arced about axis 38 by a motor 40 via gearing 41 driving a shaft 42 drivably carrying the arm 8.

The cutter head 32 is driven by a motor 45 via gearbox 46 carried by the forwardly extending arm 7 which is arced about axis 48 by two rams 49 and connecting chain 50 drivably engaging a sprocket 51 fixedly mounted on the arm 7.

The arm 7 has a forked member 54 engaging within a forked support member 55 provided on the advanceable base 6, the arrangement being that the forked member 54 can be raised or lowered relative to the advanceable base 6 to adjust the cutting horizon of the cutter head 32 and thereby steer the machine in a vertical plane. Relative vertical movement of the two forked members is controlled by a hydraulic ram (not shown). A pivot pin (only the axis of which is shown at 48) pivotally connects the two forked members.

Cut rock loading means provided at the rear of the cutter head 32 include a barrel 60 and a helical loading vane 62 extending along the barrel.

Rams 64 are provided on the advanceable base 6 to anchor the base during cutting. Also, guide pads 66 are provided which co-act with the rams 64 to steer the machine in a horizontal plane.

Control means are provided to control the arcing of the two arms 7 and 8 to ensure the cutter heads 31 and 32 do not foul one another. Typically, the control means ensures that at any one time the two arms traverse in opposite directions so that as one cutter head is approaching the end of its traverse in one direction the other cutter head is approaching the end of its traverse in the opposite direction.

Figure 1:
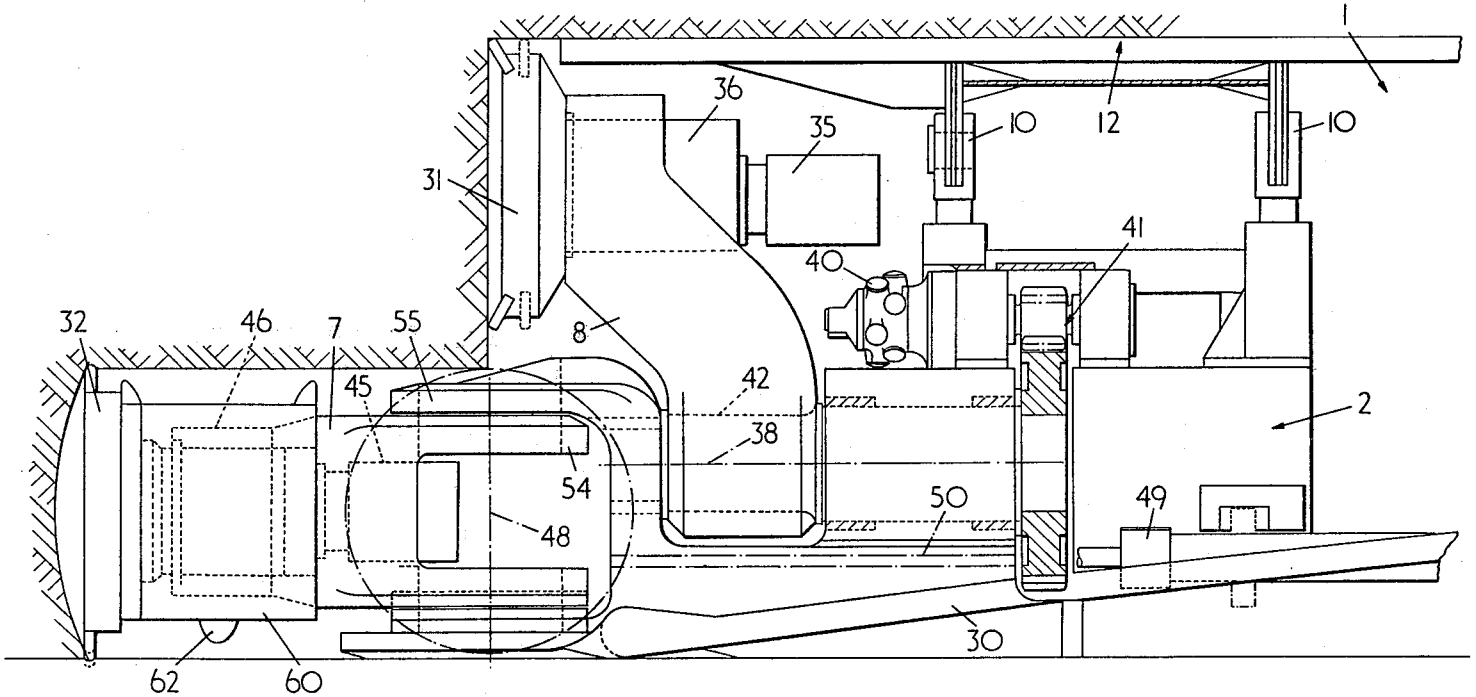
FIG. 1 is a side view of a part of a rock excavating machine forming an arch type roadway and constructed in accordance with the present invention.

In use, the cutter heads 31 and 32 are rotated and the arms 7 and 8 arc to and fro across the working rock face sections. After each complete traverse the leading portion 2 of the machine is advanced towards the newly exposed working face. It is a feature of this embodiment of excavating machine that no sumping in of the cutter heads is required. The cutter head 31 advances into the excavation formed by the cutter head 32 which during advance of the leading portion of the machine is positioned with its axis substantially normal to the direction of advance. Thus, the cutter head is free to advance into the excavation formed during previous traverses. When the cutter head 32 next traverses the working face it gradually cuts itself into the rock face (as seen by the series of projected cutting profiles in FIG. 3) until by the time the cutter head has cut half way along its traverse (i.e. the position as shown in FIGS. 1 and 3), the cutter head is fully penetrated into the rock face. Upon further traversing along the rock face the depth of penetration is reduced until by the time the end of the traverse is reached the cutter head has disengaged the rock face and is free to advance with the machine.

The loading means at the rear of the cutter head urge cut rock towards the conveyor 30 which convey the rock together with rock cut by the cutter head 31 towards the conveyor means at the rear of the stay unit 3.

When the cutter heads have completed a traverse, the leading portion 2 of the machine is advanced by releasing the roof engaging beams 16 from the mine roof and actuating the rams 5. The roof above the machine is supported during advance of the leading portion by the roof engaging beams 4 of the stay unit which remain set.

The above procedure is repeated until the leading portion has advanced a distance substantially equal to the spacing of the permanent arch roof supports set along the roadway. The stay unit is then advanced to permit the setting of the next permanent arch roof support. Once the stay unit is advanced and re-set to the mine roof the rock cutting procedure is repeated with leading portion 2 again advanced in stages.

From the above description it can be seen that the present invention provides a rock excavating machine which is able to form a generally D-shaped cross-sectional roadway suitable for the installation of arch roof supports. Although the machine in the drawings cuts into a solid rock face the cutter heads are not required to sump in. Thus, the machine is suitable for forming roadways in hard rock.

While the invention has been described with reference to specific embodiments, modifications and variations of the invention may be made without departing from the scope of the invention, which is defined in the following claims.

I claim:

1. A rock excavating machine for forming an arch type underground roadway, comprising a body for arrangement in the underground roadway, a first forwardly extended forked support member on the body, a forwardly extending large cutter carrying arm pivotally mounted with respect to the body for movement about a generally vertical axis, the arm having a second rearward extending forked support member for interfitting with the first forked support member, a short pin interconnecting the forked members and means for moving the second forked member vertically with respect to said body for vertically steering the machine, and upwardly extending large cutter carrying arm pivotally mounted with respect to the body for movement about a generally horizontal axis.

2. A machine as claimed in claim 1, in which the body has curved roof shield engaging means for engaging the rock boundary of the roadway.

3. A machine as claimed in claim 2, comprising a stay unit anchorable in the roadway and ram means for interconnecting the stay unit to the body.

4. A machine as claimed in claim 3, comprising guide pads mounted on the body for engagement with the rock boundary of the roadway to steer the machine in a generally horizontal plane.

5. A rock excavating machine for forming arch type underground roadways, comprising a body for arrangement in the underground roadway, a first forwardly extended forked support member on the body, a stay unit anchorable in the roadway, advancing ram means for interconnecting the body to the stay unit, a roof support assembly carried by the body, a forwardly extending large cutter carrying arm pivotally mounted on said forked support members for movement about a generally vertical axis and an upwardly extending large cutter carrying arm pivotally mounted on the body for movement about generally horizontal axis.

6. A machine as claimed in claim 5 in which both said arms carry rotary cutter heads rotatable about generally horizontal axes.

7. A machine as claimed in claim 6 in which the stay unit carries a roof support assembly.

8. A rock excavating machine for forming an arch type underground roadway, comprising a body unit for arrangement in the roadway, a stay unit anchorable in the roadway, advancing means for interconnecting the body unit to the stay unit for advancing one unit along the roadway relative to the other unit, a curved roof support shield carried by the body unit, a forwardly extending cutter carrying arm pivotally mounted on the body unit for movement about a generally vertical axis, arching mechanism for moving the forwardly extending cutter carrying arm about said generally vertical axis, a shaft rotatably mounted on the body unit for movement about a generally horizontal axis, an upwardly extending cutter carrying arm drivably mounted on the shaft for movement about said generally horizontal axis, drive gear mechanism for rotating the shaft to arc the upwardly extending cutter carrying arm to and fro about said generally horizontal axis, and control means for controlling said mechanisms such that in use at any one time the cutter carrying arms traverse in opposite directions, the control means ensuring that two cutter carrying arms do not foul one another.

9. A machine as claimed in claim 8, in which both the cutter carrying arms are provided with a single rotary cutter head, a gearbox drivably connected to the cutter head, and a drive motor drivably connected to the gearbox.

10. A machine as claimed in claim 9, comprising a support member for the forwardly extending cutter carrying arm which can raise or lower the said arm to steer the machine.

11. A machine as claimed in claim 9, comprising cut rock loading means extending in advance of the upwardly extending cutter carrying arm.

* * * * *